US010753237B2

(12) United States Patent
Nagaraj et al.

(10) Patent No.: US 10,753,237 B2
(45) Date of Patent: Aug. 25, 2020

(54) ACTUATION ARRANGEMENT FOR SWITCHABLE LEVER

(71) Applicant: Schaeffler Technologies AG & Co. KG, Herzogenaurach (DE)

(72) Inventors: Sumukha Nagaraj, Beverly Hills, MI (US); David Chandler, Windsor (CA); Béla Hofer, Royal Oak, MI (US)

(73) Assignee: SCHAEFFLER TECHNOLOGIES AG & CO. KG, Herzogenaurach (DE)

( * ) Notice: Subject to any disclaimer, the term of this patent is extended or adjusted under 35 U.S.C. 154(b) by 0 days.

(21) Appl. No.: 15/991,398

(22) Filed: May 29, 2018

(65) Prior Publication Data

US 2019/0368385 A1 Dec. 5, 2019

(51) Int. Cl.

*F01L 1/18* (2006.01)
*F01L 13/00* (2006.01)
*F01L 1/24* (2006.01)

(52) U.S. Cl.

CPC ..... *F01L 1/185* (2013.01); *F01L 13/0005* (2013.01); *F01L 13/0036* (2013.01); *F01L 1/2405* (2013.01); *F01L 2001/186* (2013.01); *F01L 2001/187* (2013.01); *F01L 2105/00* (2013.01)

(58) Field of Classification Search

CPC ... F01L 1/185; F01L 13/0036; F01L 13/0005; F01L 2105/00; F01L 2001/187; F01L 1/2405; F01L 2001/186

USPC ..... 123/90.16, 90.39, 90.44

See application file for complete search history.

(56) References Cited

U.S. PATENT DOCUMENTS 5,415,137 A * 5/1995 Paul ..... F01L 1/185 123/90.16
5,544,626 A * 8/1996 Diggs ..... F01L 1/185 123/198 F
6,318,318 B1 * 11/2001 Jahr ..... F01L 1/185 123/90.16
7,484,487 B2 * 2/2009 Zurface ..... F01L 1/185 123/90.39
7,503,300 B2 * 3/2009 Seitz ..... F01L 1/185 123/90.16

(Continued)

FOREIGN PATENT DOCUMENTS

DE 10206013566 A1 * 9/2007 ..... F01L 1/185
DE 102015002982 A1 * 9/2016 ..... F01L 1/18

(Continued)

*Primary Examiner* — Patrick Hamo
*Assistant Examiner* — Wesley G Harris
(74) *Attorney, Agent, or Firm* — Matthew V. Evans

(57) ABSTRACT

A switchable lever is provided that includes an outer lever, an inner lever pivotably mounted to the outer lever, and a coupling assembly that is capable of selectively locking the inner lever to the outer lever. The coupling assembly includes a coupling pin that has a first end that is configured to be received by an actuator. The coupling pin can be configured with at least one slot, which can be received by the actuator. The coupling pin is moveable from a first, locked position to a second, unlocked position, by an actuator and can be configured to be received by the actuator continuously throughout a valve lift event. The coupling pin can be configured with at least one protrusion that is arranged to be received by an actuator, or the actuator can be configured with at least one protrusion to receive the coupling pin.

20 Claims, 6 Drawing Sheets

(56) References Cited

U.S. PATENT DOCUMENTS

| | | | | |
|---|---|---|---|---|
| 8,146,552 | B2 * | 4/2012 | Seitz | F01L 13/0005 123/90.39 |
| 9,464,544 | B2 * | 10/2016 | Hwang | F01L 13/0005 |
| 2003/0111031 | A1 * | 6/2003 | Hendricksma | F01L 1/267 123/90.15 |
| 2004/0069258 | A1 | 4/2004 | Kaczmarek et al. | |
| 2005/0092273 | A1 | 5/2005 | Cecur et al. | |
| 2010/0175643 | A1 * | 7/2010 | Evans | F01L 1/14 123/90.5 |
| 2017/0198610 | A1 | 7/2017 | Haefner | |

FOREIGN PATENT DOCUMENTS

| | | | |
|---|---|---|---|
| WO | 2017144706 | A1 | 8/2017 |
| WO | 2017202845 | A1 | 11/2017 |

* cited by examiner

ACTUATION ARRANGEMENT FOR SWITCHABLE LEVER

TECHNICAL FIELD

This invention is generally related to levers, and, more particularly, to switchable levers utilized within a valve train of an internal combustion (IC) engine.

BACKGROUND

Levers are utilized within valve trains of internal combustion engines to facilitate translation of rotary motion of a camshaft to linear motion of an intake or exhaust valve. Switchable levers can include a coupling assembly that can couple or uncouple an inner lever to/from an outer lever to achieve different discrete valve lifts. The coupling assembly can be actuated by hydraulic fluid, which can require a series of hydraulic fluid galleries arranged throughout an engine, or by an electric actuator.

SUMMARY

A switchable lever is provided that includes an outer lever, an inner lever pivotably mounted to the outer lever, and a coupling assembly that is capable of selectively locking the inner lever to the outer lever. The coupling assembly includes a coupling pin that is arranged to move within a bore arranged on the outer lever. The coupling pin has a first end that is configured to be received by an actuator. The coupling pin can be configured with at least one slot, which can be received by the actuator. The slot can be formed as a circumferential groove that extends partially or fully around a circumference of the coupling pin. The coupling pin is moveable from a first, locked position to a second, unlocked position, by an actuator and can be configured to be received by the actuator continuously throughout a valve lift event. The coupling pin can be configured with at least one protrusion that is arranged to be received by an actuator. The at least one protrusion can be formed on a clip that is connected to the coupling pin. The coupling pin can also have a first locking surface located at an end opposite the first end.

A switchable lever system is provided that includes at least one switchable lever and at least one actuator. The at least one switchable lever has an outer lever, an inner lever pivotably mounted to the outer lever and a coupling assembly that is capable of selectively locking the inner lever to the outer lever. The coupling assembly includes a coupling pin that is arranged to move within a bore arranged on the outer lever. The at least one actuator receives a first end of one or more coupling pins and can continuously receive the first end throughout a valve lift event. The actuator can be configured with at least one protrusion to receive at least one slot arranged on the first end of the coupling pin. The at least one protrusion can be formed on a clip that is connected to the actuator. The at least one protrusion can include a first protrusion and a second protrusion that define a gap that is less than a diameter of the first end of the coupling pin. The at least one protrusion can be resiliently deflected to receive the first end of the coupling pin. The at least one slot that is arranged on the first end of the coupling pin can be formed as two radially opposed slots, that, when engaged by a first one and a second one of the radially opposed slots, respectively, can provide anti-rotation control of the coupling pin.

BRIEF DESCRIPTION OF THE DRAWINGS

The above mentioned and other features and advantages of the embodiments described herein, and the manner of attaining them, will become apparent and better understood by reference to the following descriptions of multiple example embodiments in conjunction with the accompanying drawings. A brief description of the drawings now follows.

DETAILED DESCRIPTION OF THE EMBODIMENTS

Figure 1:
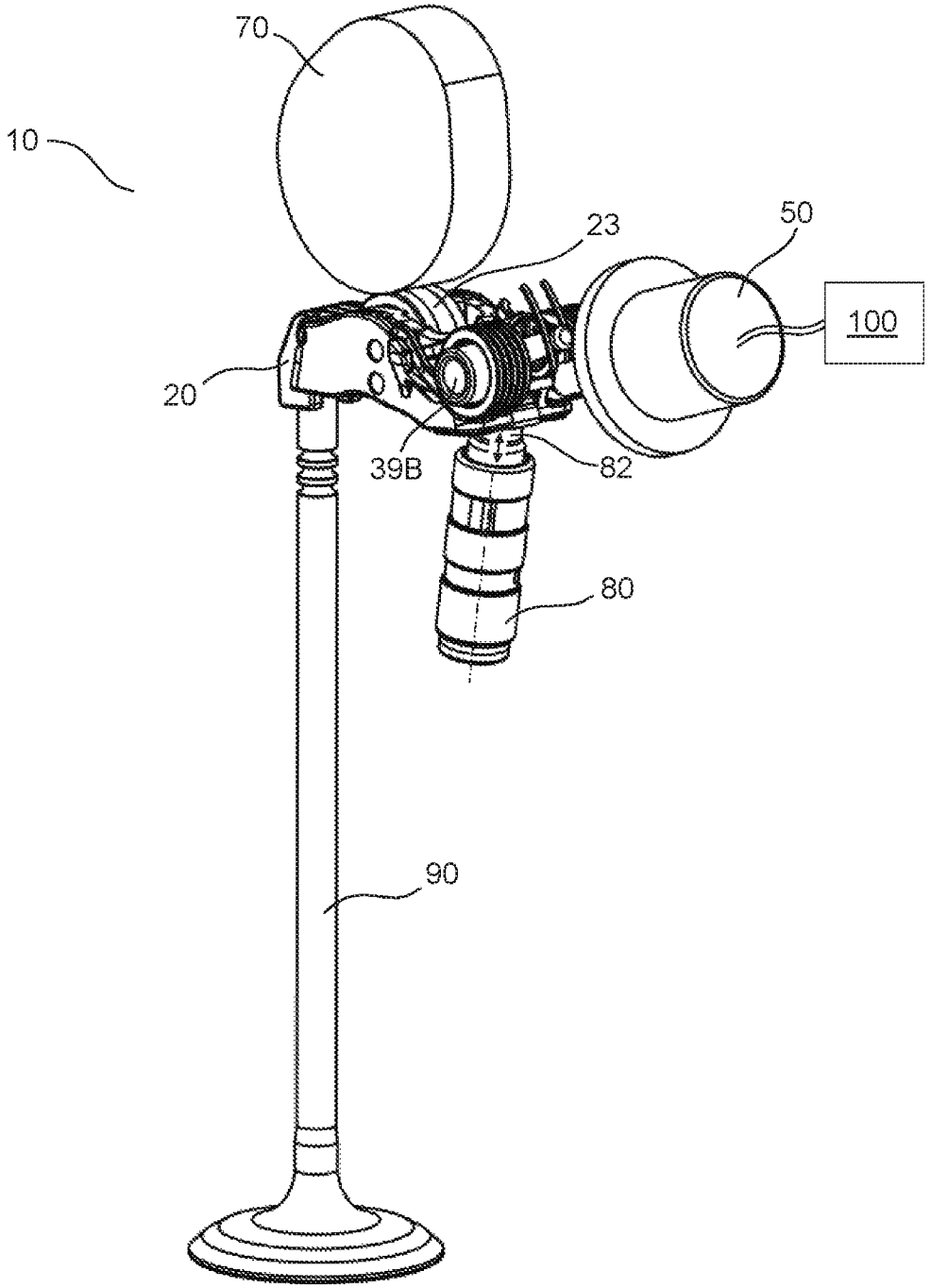
FIG. 1 is a perspective view of a valve train system for an IC engine that includes an example embodiment of a switchable lever and an actuator.
Figure 2:
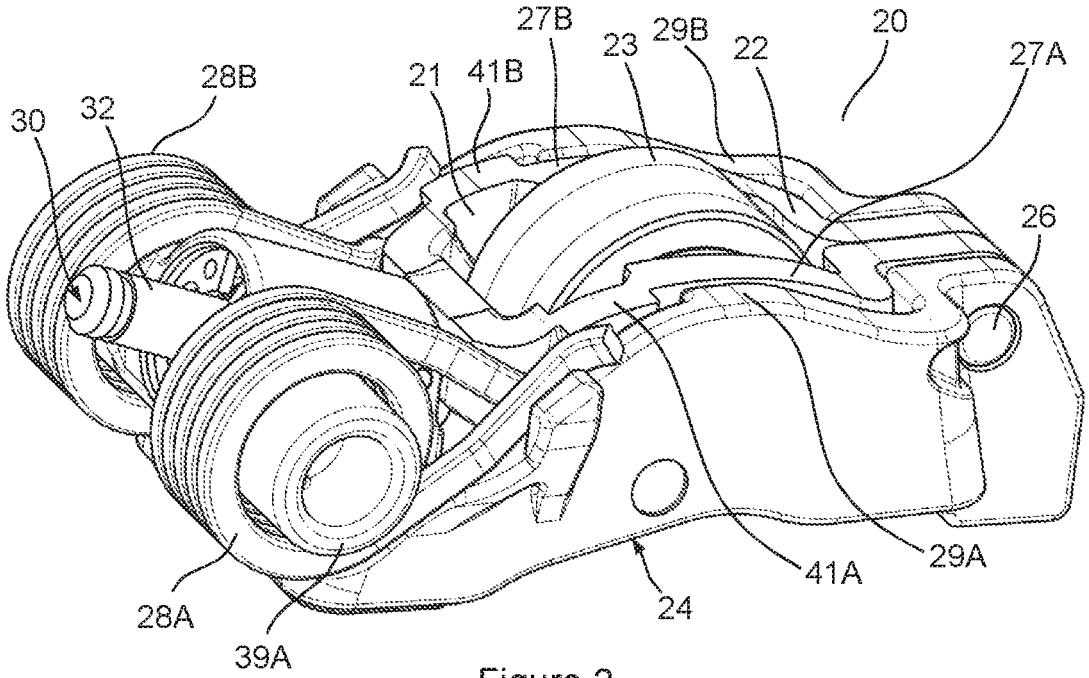
FIG. 2 is a perspective view of the switchable lever shown in FIG. 1 that includes an example embodiment of a coupling assembly.

Identically labeled elements appearing in different figures refer to the same elements but may not be referenced in the description for all figures. The exemplification set out herein illustrates at least one embodiment, in at least one form, and such exemplification is not to be construed as limiting the scope of the claims in any manner. Certain terminology is used in the following description for convenience only and is not limiting. The words "inner," "outer," "inwardly," and "outwardly" refer to directions towards and away from the parts referenced in the drawings. Axially refers to directions along a diametric central axis. Radially refers to directions that are perpendicular to the central axis. The words "left", "right", "up", "upward", "down", and "downward" designate directions in the drawings to which reference is made. The terminology includes the words specifically noted above, derivatives thereof, and words of similar import.

Referring to FIG. 1, a perspective view of a switchable lever 20 is shown within a valve train system 10 of an IC engine (not shown) that includes a camshaft 70, a hydraulic pivot element 80, an engine valve 90, an actuator 50, and an electronic controller 100. A non-hydraulic or mechanical pivot element could also be utilized within the valve train system 10. The electronic controller 100 can control actuation, and the timing thereof, of the actuator 50. The camshaft 70 actuates the switchable lever 20 through a roller 23 interface about the hydraulic pivot element 80, causing rotational lift provided by the camshaft 70 to be translated to linear lift of the engine valve 90. A single "valve event" is facilitated by one rotation of the camshaft 70, encompassing opening and closing of the engine valve 90.

Referring now to FIGS. 1 through 6B, a detailed explanation of the design and function now follows for the switchable lever 20. The switchable lever 20 includes an outer lever 24 pivotably connected to an inner lever 22 by a pivot axle 26. The outer lever 24 has two outer arms 29A, 29B that extend along respective longitudinal sides 27A, 27B of the inner lever 22. A cavity 21 within the inner lever 22 houses the roller 23 that interfaces with the camshaft 70 shown in FIG. 1. The roller 23 is connected to the inner lever 22 via a transverse axle pin 31 disposed within two axle apertures (not shown) of the inner lever 22. Optional needle rollers 44 can be arranged between the roller 23 and the axle pin 31. Lost motion resilient elements or springs 28A, 28B are arranged on respective lost motion spring posts 39A, 39B of the outer lever 24. The lost motion springs 28A, 28B are arranged to apply an upward force against lost motion spring landings 41A, 41B located on the inner lever 22 to bias the roller 23 of the inner lever 22 to an upper-most position.

Figure 6A:
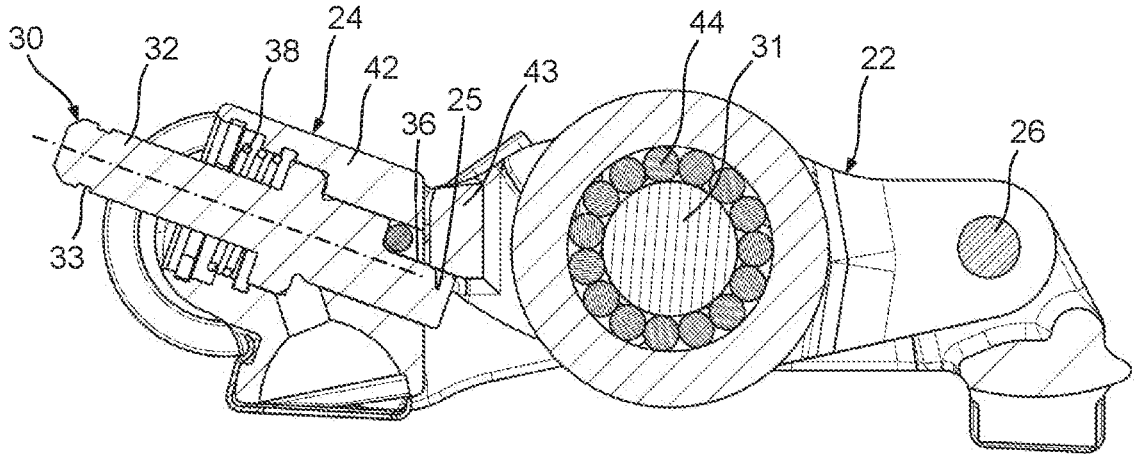
FIG. 6A is cross-sectional view of the switchable lever of FIG. 1, shown in a first, locked position.
Figure 6B:
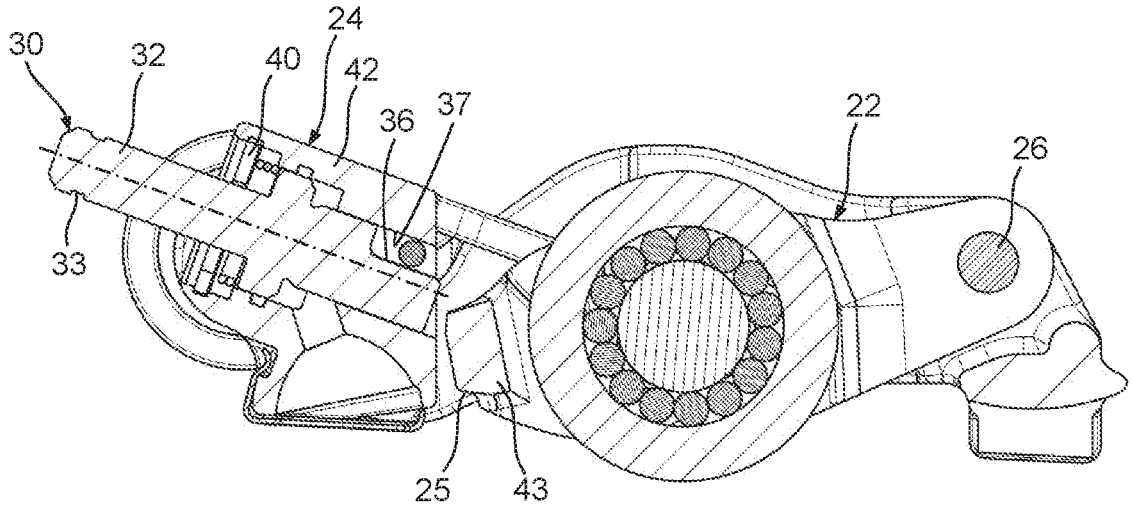
FIG. 6B is a cross-sectional view of the switchable lever of FIG. 1, shown in a second, unlocked position.

With reference to FIGS. 6A and 6B, a locking end 42 of the outer lever 24 is configured with a coupling assembly 30 that can selectively lock the inner lever 22 to the outer lever 24, achieving at least two valve lift modes. A first, locked position of the coupling assembly 30 is shown in FIG. 6A and a second, unlocked position of the coupling assembly 30 is shown in FIG. 6B. In an example embodiment, the coupling assembly 30 includes a coupling pin 32 that moves within a bore 37, a bias spring 38, and a retention clip 40 to contain the coupling assembly 30. Many different forms of coupling assemblies are possible, including, but not limited to those that include at least one additional sliding pin and/or bore. It may be possible to eliminate the bias spring 38 from the coupling assembly 30, depending on the configuration of the actuator 50.

With reference to FIGS. 1 and 6A, the coupling pin 32 is shown in a first, locked position in which the inner lever 22 and the outer lever 24 pivot in unison about the hydraulic pivot element 80, resulting in a first valve lift mode. The first, locked position is enabled when the actuator 50, engaged with the coupling pin 32, is in an extended position such that a first locking surface 36 of the coupling pin 32 is engaged with a second locking surface 25 on a lost motion end 43 of the inner lever 22 when the switchable lever 20 is loaded during a valve event.

Now referencing FIGS. 1 and 6B, the coupling pin 32 is shown in a second, unlocked position. In this state, the inner lever 22 is allowed to rotate about the pivot axle 26 during each camshaft 70 rotation, resulting in an arcuate motion of the inner lever 22, often termed lost motion, while the outer lever 24 remains stationary. The second, unlocked position is enabled when the actuator 50 retracts the coupling pin 32 such that no portion of the first locking surface 36 of the coupling pin 32 can engage with the second locking surface 25 of the inner lever 22 during a valve lift event. The second, unlocked position facilitates a second valve lift mode.

Figure 3:
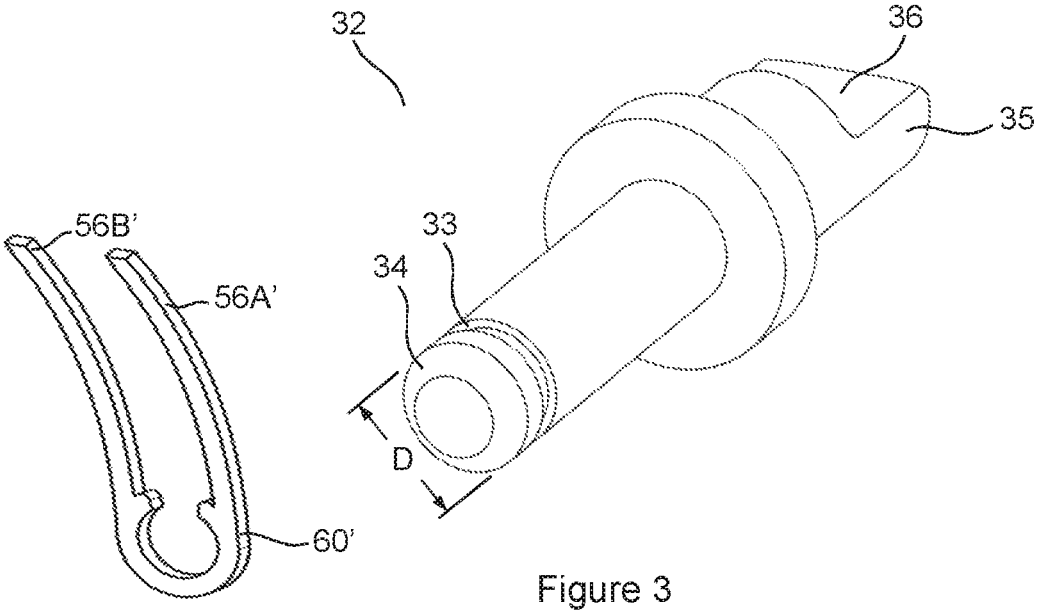
FIG. 3 is a perspective view of a coupling pin of the coupling assembly shown in FIG. 2 together with an optional clip.
Figure 4A:
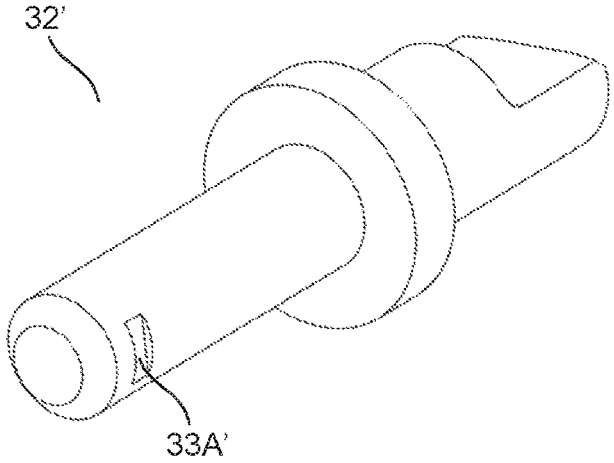
FIG. 4A is a perspective view of an example embodiment of a coupling pin.
Figure 4B:
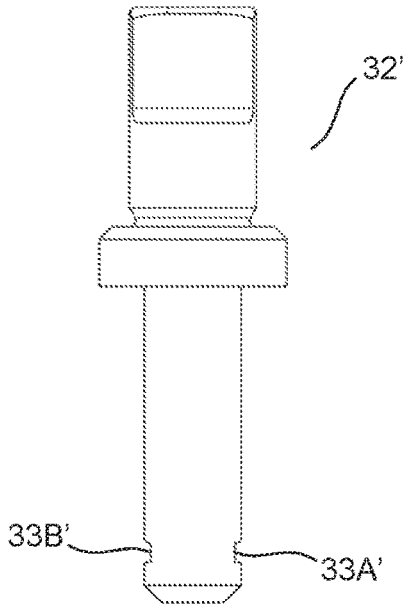
FIG. 4B is a top view of the coupling pin shown in FIG. 4A.

With reference to FIG. 3, the coupling pin 32 is shown configured with a coupling projection 35. The preferred material of the coupling pin 32 is steel, but other suitable materials are also possible. The first locking surface 36 is configured on a coupling projection 35 as a flat but can be of any suitable form for such a locking function. A first end 34 of the coupling pin 32 is configured to be received by the actuator 50. In the example embodiment shown in FIG. 3, the first end 34 is configured with a slot 33. The first end 34 of the coupling pin 32 can have many different forms to be received by the actuator 50. As shown in FIG. 3, the slot 33 can be formed as a circumferential groove that extends around the circumference of the first end 34 of the coupling pin 32. The circumferential groove does not need to extend completely around the coupling pin 32. FIGS. 4A and 4B show an example embodiment of a coupling pin 32' where the slot 33 is formed as two radially opposed slots 33A', 33B'.

The actuator 50 can have many different forms and configurations. The term "actuator" is used throughout the specification and claims and is intended to define a component, or assembly of components that receives and actuates the coupling pin 32 of the switchable lever 20. The term "receive" and its derivatives ("receives", "received", etc.) are used throughout the specification and claims and are intended to represent that the actuator 50, by receiving the coupling pin 32, couples with the coupling pin 32 in a way that permits the actuator 50 to control a position of the coupling pin 32. In an example embodiment shown in FIG. 5A, the actuator 50 is configured with a solenoid-controlled actuator pin 52. Power delivery to the actuator 50, and timing thereof, can be managed by the electronic controller 100 shown in FIG. 1, such as an electronic control unit (ECU) of an IC engine. The actuator pin 52 can be configured with many different forms to receive the coupling pin 32 of the switchable lever 20. In the example embodiment of FIG. 5A the actuator pin 52 is configured with a first protrusion 56A and a second protrusion 56B that receives the slot 33 of the coupling pin 32 shown in FIG. 3. A single protrusion, instead of two, may also suffice. The first and second protrusions 56A, 56B may be formed in such a way, possibly influenced by material choice, to have an elastic or resilient characteristic to aid in their function of receiving or engaging the coupling pin 32. The first and second protrusions 56A, 56B can define a gap W that is less than a diameter D of the first end 34 of the coupling pin 32. The first and second protrusions 56A, 56B can resiliently expand such that they can receive and engage the slot 33 of the coupling pin 32.

Referring to FIGS. 4A and 4B, an example embodiment of a coupling pin 32' is shown that is formed with two radially opposed slots 33A', 33B'. Engagement of these slots 33A', 33B' by the first and second protrusions 56A, 56B of the actuator 50 of FIG. 5A can provide anti-rotation control of the coupling pin 32 to ensure alignment of its first locking surface 36 to the second locking surface 25 of the inner lever 22.

Figure 7A:
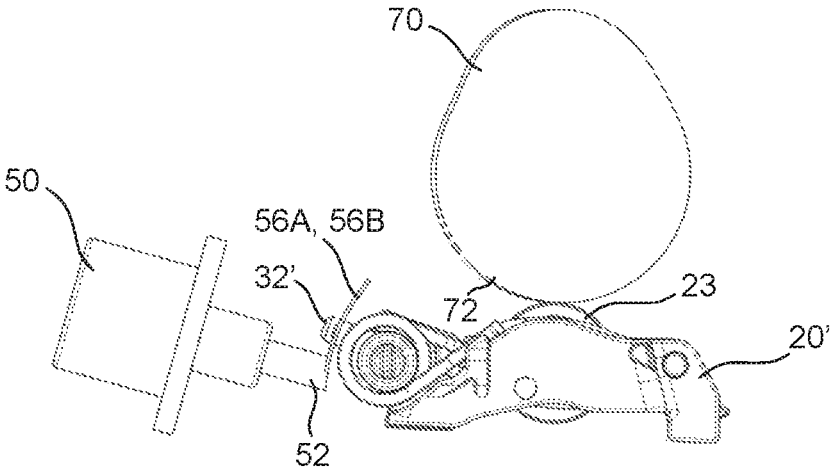
FIG. 7A is a side view of an example embodiment of a switchable lever together with the coupling pin of FIG. 4A, with the switchable lever engaged with a base circle of a camshaft.
Figure 7B:
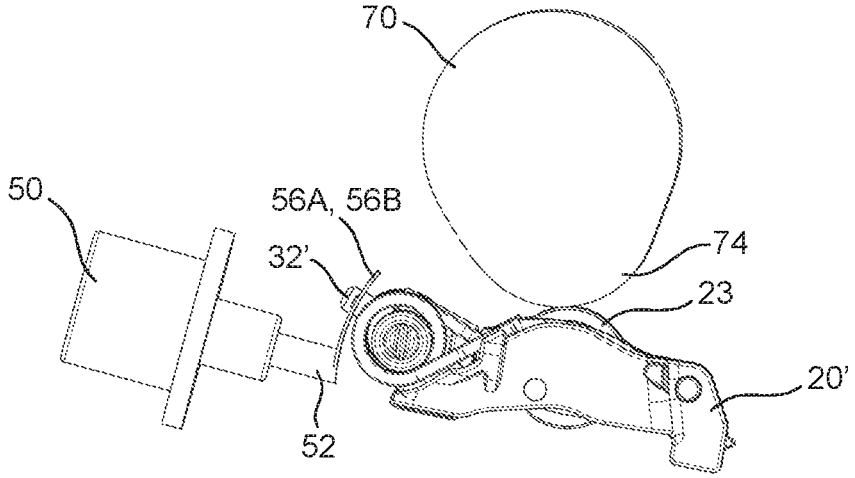
FIG. 7B is a side view of the switchable lever and coupling pin of FIG. 7A, with the switchable lever engaged with a lift portion of the camshaft.

Now referring to FIGS. 7A and 7B with view to FIG. 1, a switchable lever 20' is shown with the coupling pin 32' of FIG. 4A being received by the actuator 50. In FIG. 7A, a base circle portion 72 of the camshaft 70 is engaged with the roller 23 of the switchable lever 20', therefore no rotational motion is being translated from the camshaft 70 to the engine valve 90. In FIG. 7B, a lift portion 74 of the camshaft 70 is engaged with the roller 23 of the switchable lever 20', resulting in a pivoting motion of the switchable lever 20', translating rotational motion of the camshaft 70 to linear motion of the engine valve 90. It should be noted that the coupling pin 32' can be continuously received by the actuator 50 throughout a valve lift event represented by a single rotation of the camshaft 70. Stated more specifically, the first and second protrusions 56A, 56B can continuously receive the coupling pin 32' throughout a valve lift event. Furthermore, the actuator 50 can be configured to receive the coupling pin 32' of the switchable lever 20' with the hydraulic pivot element 80 at various heights. Throughout its lifetime in an IC engine, the hydraulic pivot element 80 can function at many different heights or axial operating positions of a top plunger 82 (see FIG. 1). The different heights can be a result of, but not limited to, varying hydraulic fluid pressure, problematic operation, or wear that occurs within various valve train components. While at any of these hydraulic pivot element heights, the switchable lever 20' receives rotary motion from the camshaft 70, and pivots upon the hydraulic pivot element 80 to open and close the engine valve 90; thus, the switchable lever 20' tilts or angularly rotates during a valve lift event, resulting in a varying position of the coupling pin 32'.

To accommodate the variable positions of the coupling pin 32', various "fits" between the actuator 50 and coupling pin 32' can be utilized for optimum function. These various fits can be capable of enabling the act of receiving the slots 33A', 33B' of the coupling pin 32' by the actuator 50 continuously throughout a valve lift event not only in the first, locked position, but also in the second, unlocked position. It may also be possible to incorporate an amount of lash between the actuator 50 and the slots 33A', 33B' of the coupling pin 32'. Furthermore, the previously described resilient nature of the form of the actuator 50 may play a role in the design fitment between the actuator 50 and coupling pin 32'.

Figure 5A:
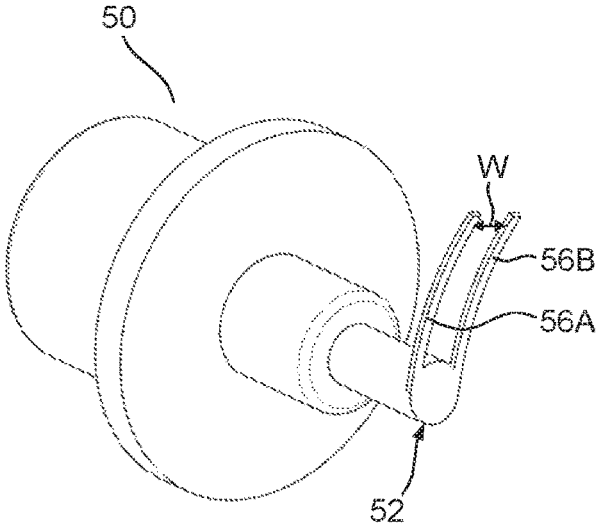
FIG. 5A is a perspective view of the actuator shown in FIG. 1.
Figure 5B:
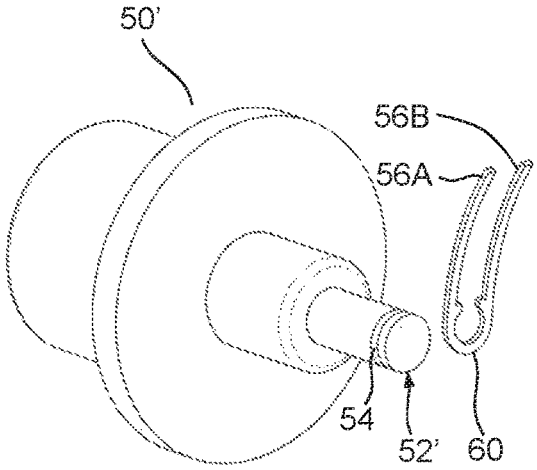
FIG. 5B is a perspective view of an example embodiment of an actuator together with an optional clip.

Referring to FIG. 5B, an example embodiment of an actuator 50' is shown having an actuator pin 52' formed with a groove 54 to receive an optional clip 60. The clip 60 is configured with the previously described first protrusion 56A' and the second protrusion 56B' to receive either of the previously described coupling pins 32, 32'. The clip 60 can have many different shapes and forms, other than what is shown, to receive either of the coupling pins 32, 32'. Furthermore, with reference to FIG. 3, instead of being installed on the actuator 50', an optional clip 60' could also be installed within the slot 33 of the coupling pin 32, or within the two radially opposed slots 33A', 33B' of the coupling pin 32' of FIGS. 4A and 4B. Therefore, the protrusions 56A', 56B', 56A, 56B can be applied to either the coupling pins 32, 32' or the actuator 50, 50', respectively.

Figure 8A:
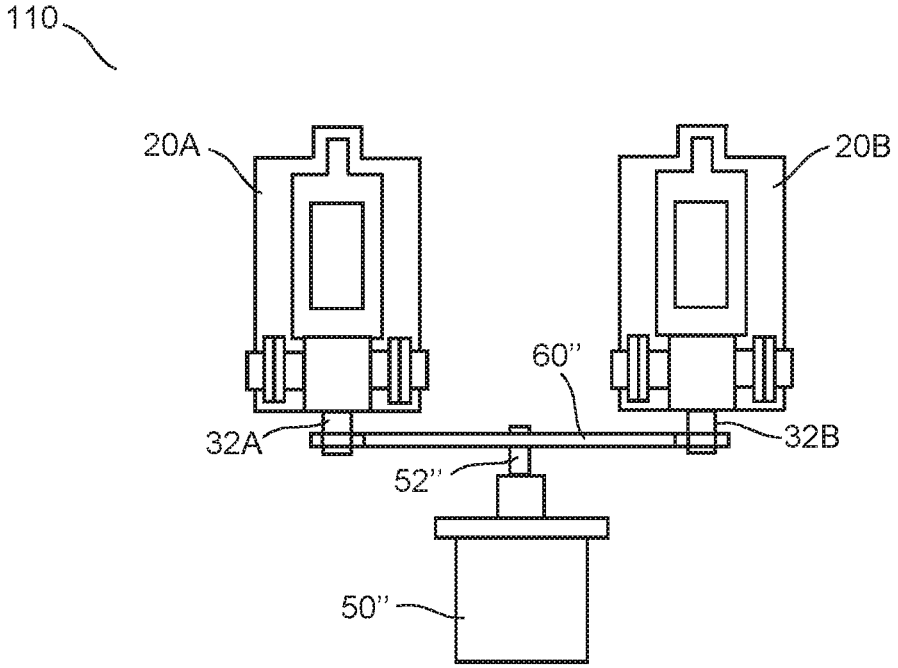
FIG. 8A is a top view of a switchable lever system that includes two switchable levers, an actuator, and an actuator clip that is capable of receiving two coupling pins.
Figure 8B:
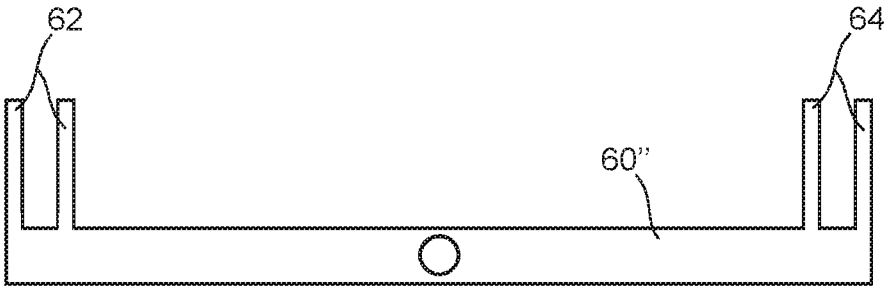
FIG. 8B is a side view of the actuator clip of FIG. 8A.

Referring to FIG. 8A, a top view of a switchable lever system 110 is shown that includes two switchable levers 20A, 20B together with an actuator 50" configured with a clip 60" that is capable of receiving two coupling pins 32A, 32B. The clip 60", a side view of which is shown in FIG. 8B, is connected to an actuator pin 52" and receives and actuates the coupling pins 32A, 32B via two pairs of protrusions 62, 64.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, to the extent any embodiments are described as less desirable than other embodiments or prior art implementations with respect to one or more characteristics, these embodiments are not outside the scope of the disclosure and can be desirable for particular applications.

What is claimed is:

1. A switchable lever comprising:
a first lever;
a second lever pivotably mounted to the first lever; and,
a coupling assembly capable of selectively locking the second lever to the first lever, the coupling assembly including:
a coupling pin arranged to move within a bore arranged in the first lever, a first end of the coupling pin configured to be coupled to a clip that is coupled to an end of an actuator; and,
during a pivoting motion of the first lever, the first end of the coupling pin is configured to move relative to the end of the actuator while being coupled the end of the actuator via the clip.

2. The switchable lever of claim 1, wherein the first end of the coupling pin is configured with at least one slot, the at least one slot configured to be received by the clip.

3. The switchable lever of claim 2, wherein the at least one slot is formed as at least one circumferential groove that extends at least partially around a circumference of the coupling pin.

4. The switchable lever of claim 2, wherein the at least one slot comprises two radially opposed slots.

5. The switchable lever of claim 1, wherein the coupling pin is moveable from a first, locked position to a second, unlocked position.

6. The switchable lever of claim 1, wherein the coupling pin is configured to be coupled to the actuator continuously throughout a valve lift event.

7. The switchable lever of claim 1, wherein the coupling pin is configured to receive at least one protrusion of the clip.

8. The switchable lever of claim 1, wherein a second end of the coupling pin is configured with a first locking surface.

9. A switchable lever system comprising:
at least one switchable lever comprising:
a first lever;
a second lever pivotably mounted to the first lever;
a coupling assembly capable of selectively locking the second lever to the first lever, the coupling assembly including:
a coupling pin arranged to move within a bore arranged in the first lever; and,
an actuator; and,
a clip arranged to couple a first end of the coupling pin to an end the actuator; and,
during a pivoting motion of the first lever, the first end of the coupling pin moves relative to the end of the actuator while being coupled to the end of the actuator via the clip.

10. The switchable lever system of claim 9, wherein the coupling pin is configured to be coupled to the actuator continuously throughout a valve lift event.

11. The switchable lever system of claim 9, wherein the clip is arranged on the actuator.

12. The switchable lever system of claim 9, wherein the first end of the coupling pin is configured with at least one slot to receive the clip.

13. The switchable lever system of claim 12, wherein the at least one slot comprises two radially opposed slots.

14. The switchable lever system of claim 13, wherein a first one of the two radially opposed slots is received by a first protrusion of the clip, and a second one of the two radially opposed slots is received by a second protrusion of the clip.

15. The switchable lever system of claim 12, wherein the at least one slot is formed as at least one circumferential groove that extends at least partially around a circumference of the coupling pin.

16. The switchable lever system of claim 12, wherein the clip is configured with at least one protrusion to receive the at least one slot.

17. The switchable lever system of claim 16, wherein the at least one protrusion is resiliently deflected to receive the first end of the coupling pin.

18. The switchable lever system of claim 16, wherein the at least one protrusion comprises a first protrusion and a second protrusion.

19. The switchable lever system of claim 18, wherein the first protrusion and the second protrusion define a gap.

20. The switchable lever system of claim 19, wherein a width of the gap is less than a diameter of the first end of the coupling pin.

* * * * *